US010944223B2

(12) United States Patent
Takeuchi

(10) Patent No.: US 10,944,223 B2
(45) Date of Patent: Mar. 9, 2021

(54) ELECTRICAL CONNECTOR HAVING A CONNECTOR HOUSING AND A FLANGE PLATE

(71) Applicant: Sumitomo Wiring Systems, Ltd., Mie (JP)

(72) Inventor: Michiyo Takeuchi, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/713,637

(22) Filed: Dec. 13, 2019

(65) Prior Publication Data

US 2020/0203900 A1 Jun. 25, 2020

(30) Foreign Application Priority Data

Dec. 25, 2018 (JP) ..... JP2018-240500

(51) Int. Cl.

| | |
|---|---|
| ***H01R 13/74*** | (2006.01) |
| ***H01R 13/52*** | (2006.01) |
| *H01R 12/70* | (2011.01) |
| *H01R 13/502* | (2006.01) |
| *H01R 4/30* | (2006.01) |
| *H01R 13/518* | (2006.01) |
| *H01R 13/516* | (2006.01) |
| *H01R 13/405* | (2006.01) |
| *H01R 11/28* | (2006.01) |

(52) U.S. Cl.

CPC ..... *H01R 13/748* (2013.01); *H01R 13/5202* (2013.01); *H01R 4/30* (2013.01); *H01R 11/283* (2013.01); *H01R 12/7047* (2013.01); *H01R 13/405* (2013.01); *H01R 13/502* (2013.01); *H01R 13/516* (2013.01); *H01R 13/518* (2013.01); *H01R 13/74* (2013.01); *H01R 2201/26* (2013.01)

(58) Field of Classification Search

CPC ..... H01R 13/748; H01R 13/5202; H01R 13/405; H01R 13/74; H01R 2201/226; H01R 12/7047; H01R 13/6215; H01R 13/516; H01R 13/518; H01R 11/283; H01R 4/30; H01R 13/502

USPC ..... 439/277, 564, 569–570, 548, 556, 559

See application file for complete search history.

(56) References Cited

U.S. PATENT DOCUMENTS

| | | | | |
|---|---|---|---|---|
| 10,158,192 | B1 * | 12/2018 | Yokotani | H01R 13/5845 |
| 2018/0006523 | A1 * | 1/2018 | Ishibashi | H01R 13/6315 |
| 2018/0351284 | A1 * | 12/2018 | Miyazawa | H01R 13/518 |

FOREIGN PATENT DOCUMENTS

| | | | | |
|---|---|---|---|---|
| JP | 2012-238465 | | 12/2012 | |
| JP | 2014-232718 | | 12/2014 | |
| WO | WO-2017098885 | A1 * | 6/2017 | H01R 13/5219 |

* cited by examiner

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

A connector (1) is provided with a plurality of connector terminals (2), a connector housing (3) and a flange plate (4). The flange plate (4) includes plate attaching portions (41) to be attached into an attachment recess (311) in the outer periphery of a connector body (31) of the connector housing (3) and a plate mounting portion (42) connected to the plate attaching portions (41) and projecting from the outer periphery of the connector body (31). The plate mounting portion (42) is formed with an insertion hole (421) through which a bolt (6) is inserted.

7 Claims, 7 Drawing Sheets

ELECTRICAL CONNECTOR HAVING A CONNECTOR HOUSING AND A FLANGE PLATE

BACKGROUND

Field of the Invention

The invention relates to a connector provided with a connector terminal and a connector housing.

Related Art

A connector for relaying electrical wiring is used in various machine components when the electrical wiring is laid between an electronic control component and a control device. The connector is provided with connector terminals, a connector body through which the connector terminals penetrate, two connector attaching portions formed on the connector body while surrounding both end parts of the connector terminals, and a mounting portion projecting toward an outer peripheral side of the connector body and including an insertion hole into which a bolt is inserted. The connector is mounted on a case of the machine component by tightening the bolt inserted into the insertion hole of the mounting portion with the connector body arranged in an arrangement hole of the case of the machine component. Further, the connector relays wiring connected to mating connectors by attaching the mating connectors into the connector attaching portions.

The mounting portion of the connector is molded integrally to the connector body using the same resin material as a resin material constituting the connector body portion. The connector body is arranged in the arrangement hole formed in a cover of the machine component and the mounting portion is mounted on the case of the machine component by a bolt or the like.

Japanese Unexamined Patent Publication No. 2012-238465 discloses a connector including a connector body integrally molded with a mounting portion. Further, Japanese Unexamined Patent Publication No. 2014-232718 discloses a connector in which a mounting portion radially formed from a connector body is locked to an edge of an arrangement hole in which the connector body portion is arranged.

In the conventional connector, the mounting portion is molded integrally to the connector body, and a positional relationship of the connector body and the mounting portion is fixed. Thus, in the case of using plural types of connectors having different positional relationships of a center axis of a connector body and a center of an insertion hole of a mounting portion, plural types of connectors including mounting portions different in shape need to be molded.

The invention was developed in view of the above problem and aims to provide a connector enabling easy manufacturing of plural types of connectors having different positional relationships of a center axis of a connector body and a center of an insertion hole of a plate mounting portion.

SUMMARY

One aspect of the invention is directed to a connector with connector terminals and a connector housing including a connector body for covering intermediate parts of the connector terminals but not covering both end parts. A connector attaching portion is formed on an end part in a direction of a center axis of the connector body and has a tubular shape to surround the end parts of the connector terminals. A mating connector is attached into the connector attaching portion. A flange plate includes a plate attaching portion to be attached into an attachment recess in an outer periphery of the connector body. A plate mounting portion is connected to the plate attaching portion and projects from the outer periphery of the connector body. An insertion hole is formed in the plate mounting portion, and a bolt is inserted into the insertion hole.

The connector housing of the above-described connector is separate from the flange plate. The flange plate includes the plate attaching portion and the plate mounting portion formed with the insertion hole. The flange plate is attached to the connector housing by attaching the plate attaching portion into the attachment recess in the outer periphery of the connector body. In this way, the flange plate and the connector housing can be integrated. When the connector is arranged in an arrangement hole of a case of a machine component thereafter, the bolt inserted into the insertion hole of the plate mounting portion of the flange plate is tightened into the case of the machine component.

Plural types of connectors may be used and may have different positional relationships of the center axis of the connector body and the center of the insertion hole of the plate mounting portion. Such a case can be handled by manufacturing plurality types of flange plates different in length from a center of the plate attaching portion to the center of the insertion hole. That is, the connector housing is used as a common component, whereas plural types of flange plates different in shape are prepared. Plural types of connectors having different positional relationships of the center axis of the connector body and the center of the insertion hole of the plate mounting portion can be manufactured by changing the flange plate to be attached to the connector housing.

Therefore, according to the connector of this aspect of the invention, plural types of connectors having different positional relationships of the center axis of the connector body and the center of the insertion hole of the plate mounting portion can be manufactured easily.

DETAILED DESCRIPTION

Figure 1:
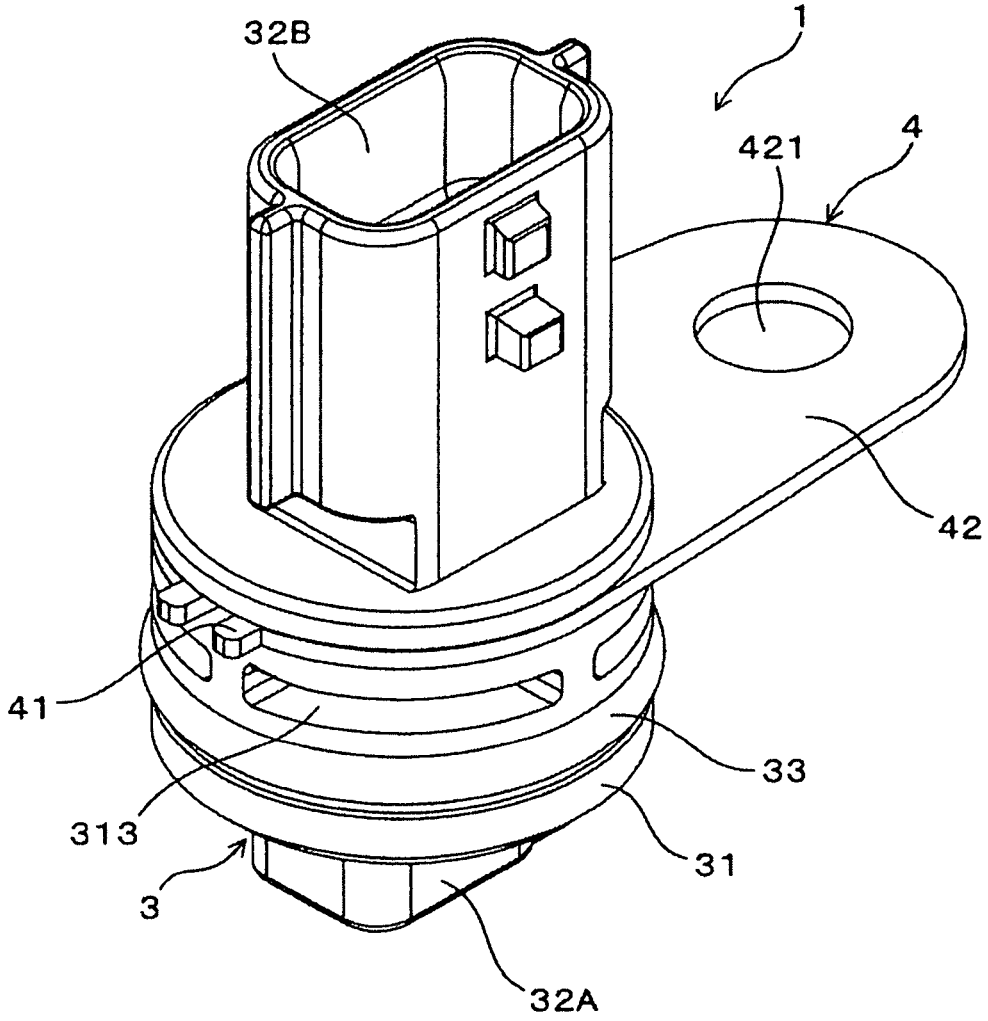
FIG. 1 is a perspective view of a connector according to an embodiment.

A connector 1 according to one embodiment includes connector terminals 2, a connector housing 3 and a flange plate 4, as shown in FIGS. 1 to 5. The connector housing 3 includes a connector body 31 for covering intermediate parts 23 of the connector terminals 2 excluding both end parts 21, 22 and connector attaching portions 32A, 32B formed on end parts in a direction of a center axis C of the connector body 31. The connector attaching portions 32A, 32B are parts into which mating connectors 5A, 5B are attached, and have a tubular shape to surround the end parts of the connector terminals 2.

The flange plate 4 includes plate attaching portions 41 to be attached into an attachment recess 311 in the outer periphery of the connector body 31, and a plate mounting portion 42 connected to the plate attaching portions 41 and projecting from the outer periphery of the connector body 31. The plate mounting portion 42 is formed with an insertion hole 421 into which a bolt 6 is inserted.

The connector 1 of this embodiment is described in detail below.

(Connector 1)

Figure 4:
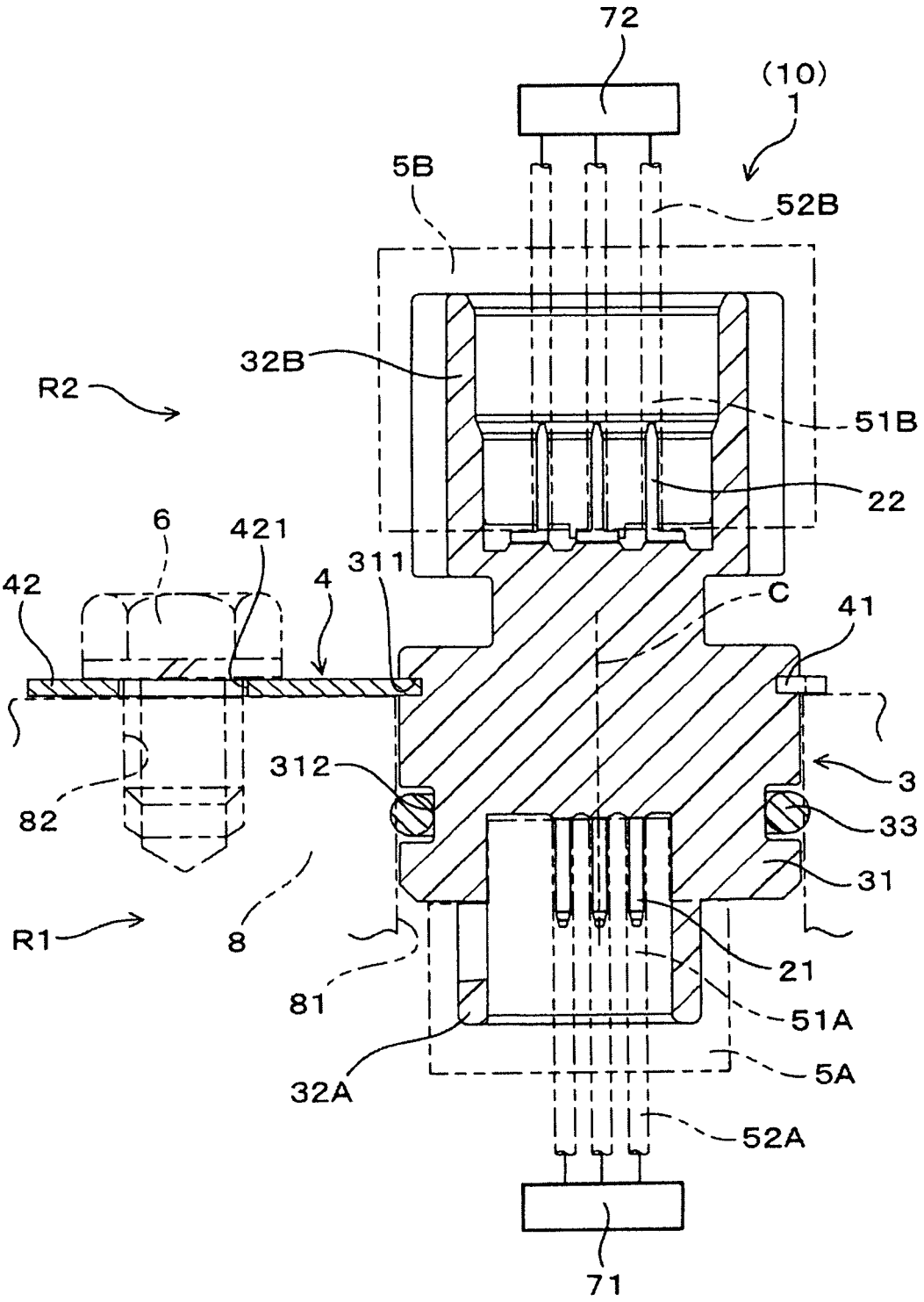
FIG. 4 is a section along IV-IV of FIG. 3 showing the connector according to the embodiment.
Figure 5:
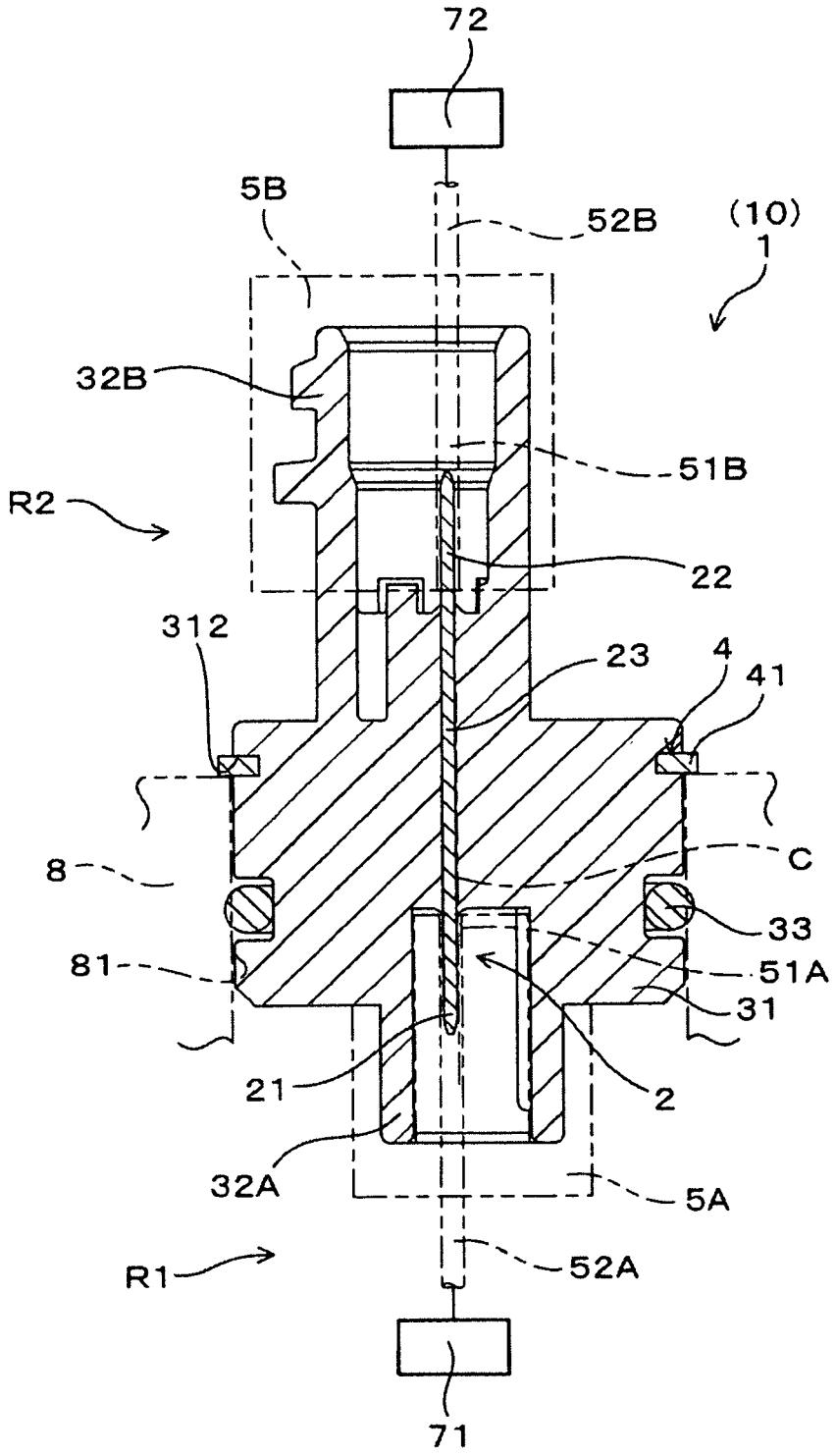
FIG. 5 is a section along V-V of FIG. 3 showing the connector according to the embodiment.

As shown in FIGS. 4 and 5, the connector 1 of this embodiment is used as a relay connector for relaying electrical wiring when electronic control equipment 71 and a control device 72 are wired electrically. The electronic control equipment 71 can be mounted in various machine components. The machine component of this embodiment is an automatic transmission mounted in an automotive vehicle, and the electronic control equipment 71 is an actuator, such as a motor, or a sensor, such as a resolver, used in the automatic transmission. The electronic control equipment 71 is connected electrically to an electronic control unit (ECU) serving as the control device 72 via the connector terminals 2 of the connector 1. In the automatic transmission, oil (automatic transmission oil) is used to perform an automatic shift control operation and to lubricate constituent components. The connector 1 is arranged in an arrangement hole 81 provided in a case 8 of the automatic transmission.

Further, the electronic control equipment 71 may be a spool valve of a valve body of the automatic transmission. Further, the machine component may be a machine component other than automatic transmissions. Further, the connector 1 may be mounted on the automatic transmission via a bracket and arranged in the arrangement hole 81 of the case 8 of the automatic transmission with loose movements with respect to the bracket allowed.

(Use Environment of Connector 1)

As shown in FIGS. 4 and 5, the connector 1 is mounted on the case 8 by the bolt 6 inserted into the insertion hole 421 of the plate mounting portion 42 with the connector body 31 arranged in the arrangement hole 81 of the case 8 of the automatic transmission. The inside of the case 8 of the automatic transmission is an oil environment R1 filled with oil, and the outside of the case 8 of the automatic transmission is an air environment R2 having a possibility of becoming wet. The connector 1 relays wires 52A wired in the oil environment R1 and wires 52B wired in the air environment R2 by the connector terminals 2.

(Connector Housing 3)

As shown in FIGS. 1, 4 and 5, two of the connector attaching portions 32A, 32B are formed on the both end parts in the direction of the center axis C of the connector body 31 in the connector housing 3. The connector attaching portions 32A, 32B include the in-oil connector attaching portion 32A formed on one side in the direction of the center axis C of the connector body 31 and arranged in the oil environment R1 and the in-air connector attaching portion 32B formed on the other side in the direction of the center axis C of the connector body 31 and arranged in the air environment R2.

The connector 1 of this embodiment is a male connector. The in-oil female connector 5A is attached into the in-oil connector attaching portion 32A, and the in-air female connector 5B is attached into the in-air connector attaching portion 32B. Female connector terminals 51A, 51B are arranged in the in-oil female connector 5A and the in-air female connector 5B. The connector terminals 2 of the connector 1 electrically connect the female connector terminals 51A of the in-oil female connector 5A and the female connector terminals 51B of the in-air female connector 5B. Note that the in-air female connector 5B may be mounted directly on a control board of the control device 72 without the wires 52B.

As shown in FIGS. 4 and 5, when the connector 1 is arranged in the arrangement hole 81 of the case 8 of the automatic transmission, the in-oil connector attaching portion 32A is arranged in the case 8 and the in-air connector attaching portion 32B projects from the arrangement hole 81 and is arranged outside the case 8. Further, the in-oil connector attaching portion 32A and the in-oil female connector 5A are arranged in the oil environment R1 where these can contact the oil. On the other hand, the in-air connector attaching portion 32B and the in-air female connector 5B are arranged in the air environment R2 and isolated from the oil environment R1 by a sealing member 33 for oil.

The connector 1, the in-oil female connector 5A attached into the in-oil connector attaching portion 32A of the connector 1 and the in-air female connector 5B attached into the in-air connector attaching portion 32B of the connector 1 constitute a connector assembly 10. A set of the connector 1, the in-oil female connector 5A and the in-air female connector 5B is handled as the connector assembly 10.

As shown in FIGS. 4 and 5, the sealing member 33 for oil for sealing between the outer periphery of the connector body 31 of the connector 1 and the arrangement hole 81 of the case 8 of the automatic transmission is attached to the outer periphery of the connector body 31. The sealing member 33 is in a groove 312 in the outer periphery of the connector body 31 and prevents leakage of the oil in the case 8 to the outside of the case 8 through a clearance between the connector 1 and the arrangement hole 81.

The connector body 31 is cylindrical, and the outer periphery of the connector body 31 includes the attachment recess 311 that receives the plate attaching portions 41 of the flange plate 4 and the groove 312 that receives the sealing member 33. The attachment recess 311 is a groove having a width slightly larger than a thickness of the plate attaching portions 41. The attachment recess 311 of this embodiment is formed over the entire circumference of the connector body 31 and is an annular groove. As shown in FIG. 1, measuring grooves 313 also are formed in parts of the connector body 31 where the attachment recess 311 and the groove 312 are not formed.

(Connector Terminals 2)

Figure 3:
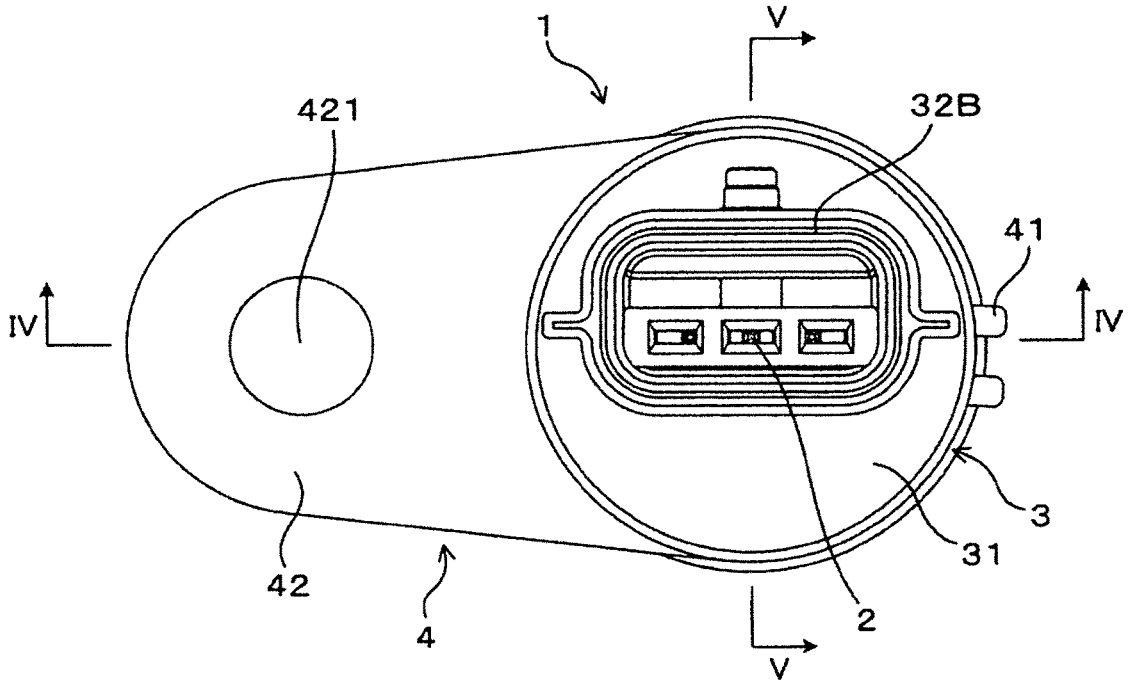
FIG. 3 is a plan view showing the connector according to the embodiment.

As shown in FIGS. 3 to 5, the intermediate parts 23 of the connector terminals 2 penetrate through the connector body 31. One end part 21 of each connector terminal 2 projects into the in-oil connector attaching portion 32A from the connector body 31, and the other end part 22 of each connector terminal 2 projects into the in-air connector attaching portion 32B from the connector body 31. The connector terminals 2 are conductor pins.

(Flange Plate 4)

Figure 2:
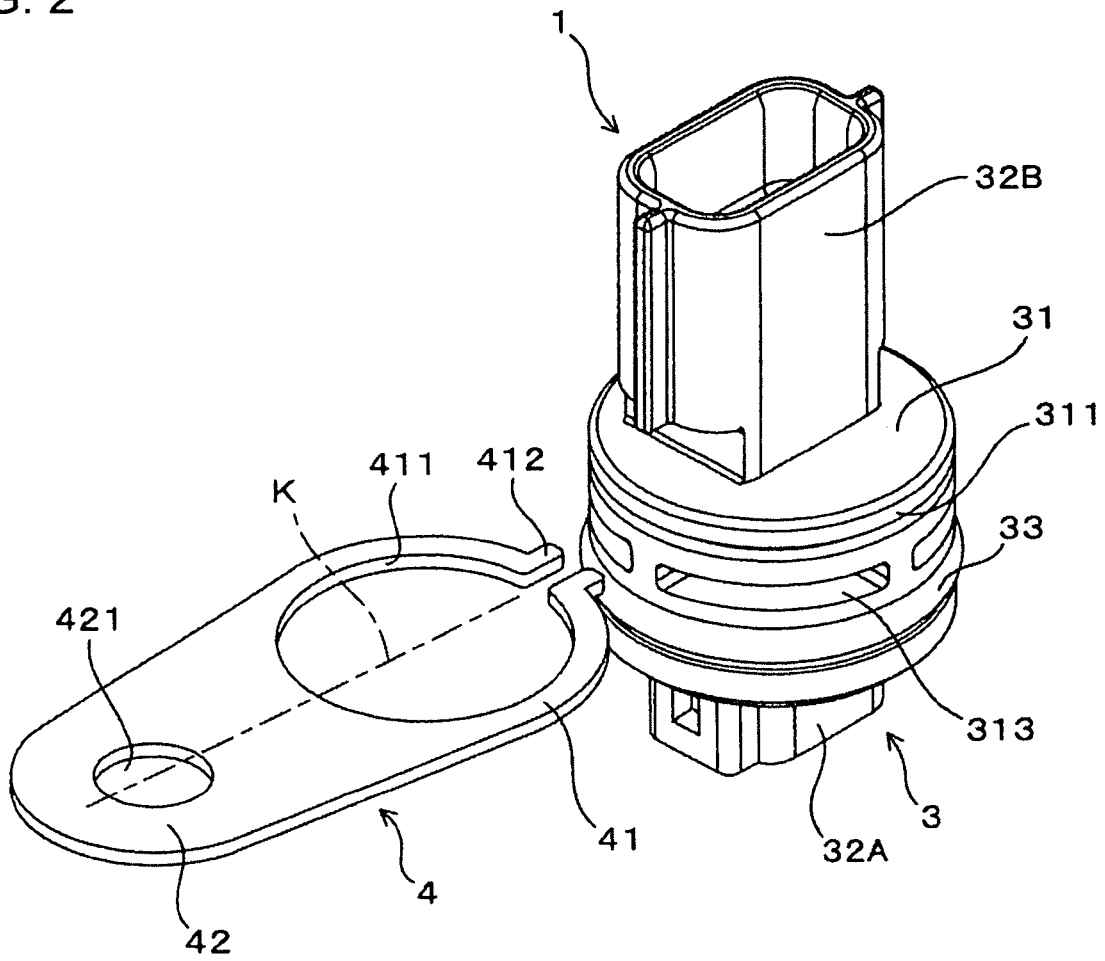
FIG. 2 is a perspective view showing the connector according to the embodiment before a flange plate is attached to a connector housing.

As shown in FIG. 2, the plate attaching portions 41 and the plate mounting portion 42 of the flange plate 4 are flat plates formed from a single steel plate, thereby facilitating the manufacturing of the flange plate 4 and enhancing the strength of the flange plate 4. The flange plate 4 can be manufactured easily from a strip-like steel plate by stamping, which is one type of press working. Further, since the steel plate is conductive, it is not necessary to arrange a conductive collar around the insertion hole 421 in the flange plate 4.

Arcuate inner peripheral surfaces 411 are formed on inner peripheral sides of the plate attaching portions 41 of the flange plate 4 and extend along the annular attachment recess 311. Two of the plate attaching portions 41 are formed respectively at both sides of a virtual line K passing through the center axis C of the connector body 31 and a center of the insertion hole 421 of the flange plate 4. The plate attaching portions 41 are formed into an arcuate shape extending along the annular attachment recess 311. A projection 412 usable in attaching and detaching the flange plate 4 into and from the attachment recess 311 is formed on a tip of each plate attaching portion 41.

By shaping the arcuate inner peripheral surface 411 of each plate attaching portion 41 to extend along the annular attachment recess 311, each plate attaching portion 41 is attached rotatably about the center axis C of the connector body 31 with respect to the attachment recess 311. In other words, the flange plate 4 can be rotated about the center axis C of the connector housing 3. In this way, a positional relationship of the insertion hole 421 of the flange plate 4 and the connector housing 3 can be changed when necessary.

As shown in FIGS. 1 and 2, the flange plate 4 is attached to the connector housing 3 in the direction of the center axis C of the connector housing 3. More specifically, the two plate attaching portions 41 of the flange plate 4 are arranged on the outer periphery of the connector body 31 in the direction of the center axis C of the connector body 31 while being resiliently deformed toward outer peripheral sides. Then, the plate attaching portions 41 are attached into the attachment recess 311 when resiliently returning toward the inner peripheral sides. The attachment of the flange plate 4 to the connector housing 3 is facilitated by attaching the flange plate 4 in this way.

Figure 6:
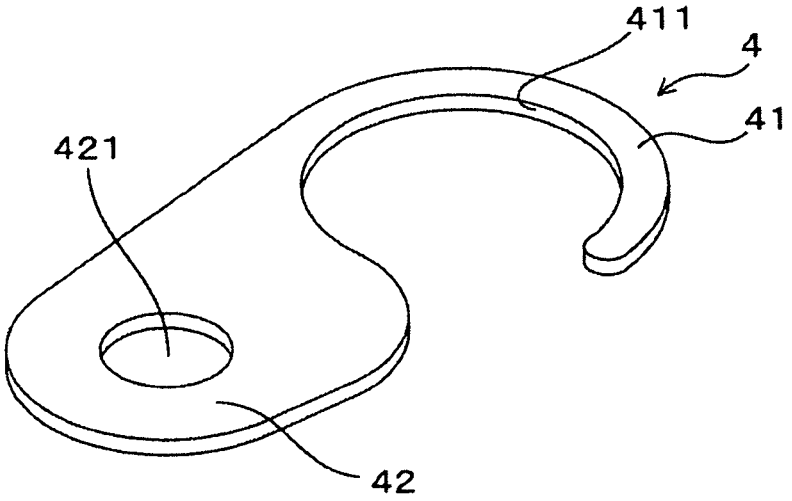
FIG. 6 is a perspective view showing another flange plate according to the embodiment.
Figure 7:
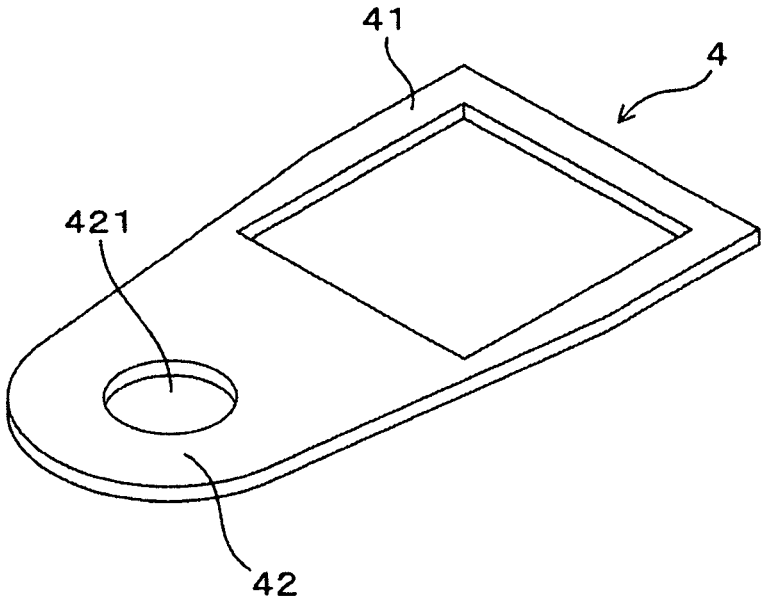
FIG. 7 is a perspective view showing another flange plate according to the embodiment.

The plate attaching portion 41 of the flange plate 4 may project arcuately from one side of the plate mounting portion 42, as shown in FIG. 6. Further, the plate attaching portion 41 of the flange plate 4 can also be formed into an annular shape, as shown in FIG. 7. The inner peripheral surfaces 411 of the plate attaching portions 41 also can be formed into a polygonal shape instead of the arcuate shape. In the case of forming the plate attaching portion 41 into an annular shape, the shape of the attachment recess 311 of the connector body 31 can be devised to facilitate the attachment of the plate attaching portion 41.

Functions and Effects

The connector 1 includes the connector housing 3 separate from the flange plate 4. The flange plate 4 is attachable to the connector housing 3 utilizing the resilient deformation of the plate attaching portions 41. The flange plate 4 includes the two plate attaching portions 41 and the plate mounting portion 42 formed with the insertion hole 421. The flange plate 4 is attached to the connector housing 3 by attaching the two plate attaching portions 41 into the attachment recess 311 in the outer periphery of the connector body 31. In this way, the flange plate 4 and the connector housing 3 are integrated. When the connector 1 is arranged in the arrangement hole 81 of the case 8 of the automatic transmission, the bolt 6 inserted into the insertion hole 421 of the plate mounting portion 42 of the flange plate 4 is tightened into the case 8 of the automatic transmission, as shown in FIG. 4.

As shown in FIG. 4, a positional relationship of the arrangement hole 81 and a screw hole 82 provided in the case 8 may differ for each case 8 due to the limitation of an arrangement space or the like in the case 8 of the machine component, such as the automatic transmission. Thus, plural types of connectors having different positional relationships of the center axis C of the connector body 31 and the center of the insertion hole 421 of the plate mounting portion 42 conventionally have been manufactured. This has made the manufacturing of connectors cumbersome.

On the other hand, this embodiment uses plural types of connectors 1 having different positional relationships of the center axis C of the connector body 31 and the center of the insertion hole 421 of the plate mounting portion 42. Thus, differences of the cases 8 can be handled by manufacturing plural types of flange plates 4 different in length from a center of the plate attaching portions 41 to the center of the insertion hole 421. That is, the connector housing 3 is used a common component, whereas plural types of flange plates 4 different in shape are prepared. Connectors 1 having different positional relationships of the center axis C of the connector body 31 and the center of the insertion hole 421 of the plate mounting portion 42 can be manufactured by changing the flange plate 4 to be attached to the connector housing 3.

Further, by changing the shape of the flange plate 4, the positional relationship of the center axis C of the connector body 31 and the center of the insertion hole 421 of the plate mounting portion 42 easily can be made different. Further, the flange plate 4 can be detached from the connector housing 3.

Therefore, plural types of connectors 1 having different positional relationships of the center axis C of the connector body 31 and the center of the insertion hole 421 of the plate mounting portion 42 can be manufactured easily. Therefore, the connector 1 can be manufactured easily by changing the shape of the flange plate 4 in accordance with various vehicle types having automatic transmissions used therein.

The present invention is not limited only to the embodiment and further different embodiments can be configured without departing from the scope of the invention. Further, the invention includes various modifications and modifications within the scope of equivalents. Furthermore, combinations, forms and the like of various constituent elements envisaged from the invention are also included in the scope of the invention.

LIST OF REFERENCE SIGNS

1 connector
2 connector terminal
3 connector housing
31 connector body
32A, 32B connector attaching portion
4 flange plate
41 plate attaching portion
42 plate mounting portion
421 insertion hole
5A, 5B mating connector (female connector)

What is claimed is:

1. A connector, comprising:

connector terminals;

a connector housing including a connector body for covering intermediate parts of the connector terminals excluding both end parts and a connector attaching portion formed on an end part of the connector body in a direction of a center axis of the connector body and having a tubular shape to surround the end parts of the connector terminals, a mating connector being attached into the connector attaching portion, and an annular groove being formed in an outer periphery of the connector body to define an annular attachment recess; and a flange plate including a plate attaching portion, a plate mounting portion connected to the plate attaching portion and an insertion hole formed in the plate mounting portion, a bolt being inserted into the insertion hole, wherein the plate attaching portion of the flange plate has an arcuate inner peripheral surface extending along the annular attachment recess of the connector body so that the plate attaching portion is attached into the annular attachment recess rotatably about the center axis of the connector body.

2. The connector of claim 1, wherein:

two of the plate attaching portions are formed respectively at both sides of a virtual line passing through the center axis of the connector body and a center of the insertion hole; and the two plate attaching portions are structured to be arranged on the outer periphery of the connector body in the direction of the center axis of the connector body while being resiliently deformed toward outer peripheral sides and to be attached into the attachment recess when resiliently returning toward inner peripheral sides.

3. The connector of claim 2, wherein the plate attaching portion and the plate mounting portion in the flange plate are formed from one steel plate.

4. The connector of claim 3, wherein:

two of the connector attaching portions are formed on both end parts in the direction of the center axis of the connector body;

the intermediate parts of the connector terminals penetrate through the connector body and the end parts of the connector terminals project into the connector attaching portions;

a sealing member for sealing between the outer periphery of the connector body and an arrangement hole of a case of a machine component is attached to the outer periphery of the connector body and the connector is used as a relay connector for relaying electrical wiring by the connector terminals by arranging the connector body in the arrangement hole and mounting the connector on the machine component by the bolt inserted into the insertion hole of the plate mounting portion.

5. The connector of claim 1, wherein the plate attaching portion and the plate mounting portion in the flange plate are formed from one steel plate.

6. A connector, comprising:

connector terminals;

a connector housing including a connector body for covering intermediate parts of the connector terminals excluding both end parts and a connector attaching portion formed on an end part of the connector body in a direction of a center axis of the connector body and having a tubular shape to surround the end parts of the connector terminals, a mating connector being attached into the connector attaching portion, and an attachment recess being formed in an outer periphery of the connector body; and a flange plate including a plate attaching portion to be attached into the attachment recess in the outer periphery of the connector body, a plate mounting portion connected to the plate attaching portion and projecting from the outer periphery of the connector body and an insertion hole formed in the plate mounting portion, a bolt being inserted into the insertion hole, wherein:

two of the plate attaching portions are formed respectively at both sides of a virtual line passing through the center axis of the connector body and a center of the insertion hole; and the two plate attaching portions are structured to be arranged on the outer periphery of the connector body in the direction of the center axis of the connector body while being resiliently deformed toward outer peripheral sides and to be attached into the attachment recess when resiliently returning toward inner peripheral sides.

7. The connector of claim 6, wherein:

the attachment recess of the connector body is an annular groove;

an arcuate inner peripheral surface extending along the annular attachment recess is formed on an inner peripheral side of the plate attaching portion of the flange plate; and the plate attaching portion is attached into the attachment recess rotatably about the center axis of the connector body.

* * * * *